US005379934A

United States Patent [19]

Lorenz

[11] Patent Number: 5,379,934

[45] Date of Patent: Jan. 10, 1995

[54] CLOSABLE TRAY

[75] Inventor: Achim R. Lorenz, Burns, Tenn.

[73] Assignee: MacMillan Bloedel Limited, Vancouver, United Kingdom

[21] Appl. No.: 193,751

[22] Filed: Feb. 7, 1994

[51] Int. Cl.[6] ..... B65D 43/04

[52] U.S. Cl. ..... 229/125.28; 229/164

[58] Field of Search ..... 229/114, 125.28, 164, 229/125.27, 939, 940, 149

[56] References Cited

U.S. PATENT DOCUMENTS

| | | | |
|---|---|---|---|
| 1,620,174 | 3/1927 | Wagner | 229/939 X |
| 2,133,930 | 10/1938 | Wagner | 229/939 X |
| 2,511,550 | 6/1950 | Simms | 229/125.28 X |
| 2,736,485 | 2/1956 | Rabby | 229/125.28 X |
| 3,447,672 | 6/1969 | Bailey et al. | 229/125.28 X |
| 4,187,977 | 2/1980 | Boykin et al. | 229/114 |
| 4,362,266 | 12/1982 | Webinger | 229/114 X |
| 4,960,238 | 10/1990 | Lorenz | 229/114 X |
| 4,984,734 | 1/1991 | Zion et al. | 229/939 X |
| 5,269,454 | 12/1993 | Perazzo | 229/125.28 X |

FOREIGN PATENT DOCUMENTS

| | | | |
|---|---|---|---|
| 2220406 | 1/1990 | United Kingdom | 229/164 |

*Primary Examiner*—Gary E. Elkins
*Assistant Examiner*—Christopher McDonald
*Attorney, Agent, or Firm*—C. A. Rowley

[57] ABSTRACT

A closable tray is provided by a bottom tray having upwardly and outwardly flaring pairs of mutually perpendicular side walls. The side walls of one such pair is longer than the side walls of the other pair and is provided with tongue receiving slots positioned spaced from the bottom wall a distance substantially equal to the spacing of supporting surfaces provided along the top edge of the walls of the other pair of opposed walls. A cooperating cover is formed by a planer top member, two pairs of mutually opposed tongues projecting in opposite directions therefrom. The planer top member preferably is slightly convex on each of its sides and each of tongue members extend from the widest portion of its respective side of the top member. The tray and cover are dimensional so that one pair of opposed tongue member cooperates with the tongue slots and the other pair of tongue members are supported on the support surfaces of the bottom tray when the cover member closes the bottom tray.

18 Claims, 3 Drawing Sheets

CLOSABLE TRAY

FIELD OF THE INVENTION

The present invention relates to a closable tray, more particularly, the present invention relates to a tray structure having a discrete substantially planer closure member adapted to cooperate with and be latched in position to close the top of the tray.

BACKGROUND OF THE PRESENT INVENTION

Closable trays of a wide variety of shapes and sizes, configurations, etc. have been invented and offered to the market. One area of the market that employs a variety of open ended trays that are closable by one means or another, is the fast-food market, for example, the home delivery pizza market, where a closable tray (generally a tray made of corrugated board to provide insulating between the hot pizza and its surroundings) has found a large degree of acceptance.

Generally, pizza boxes are formed of corrugated board and include a bottom tray and a top cover with side walls that telescope within the side wall of the bottom tray to close the container. These are one piece containers, i.e. the top and bottom are foldably interconnected, and are generally erected on the premises of the fast-food service from a single blank immediately prior to their use.

BRIEF DESCRIPTION OF THE PRESENT INVENTION

It is an object of the present invention to provide a closable tray that is relatively inexpensive and is easily stored and used.

Broadly the present invention relates to a closable tray structure comprising a tray bottom having a bottom wall and a first pair of opposed side walls and a second pair of opposed side walls, said side walls flaring upwardly from said bottom wall to form a tray, free edges at the edges of said side walls remote from said bottom wall outlining the sides of a substantially rectangular top opening of said tray, a pair of elongated tongue receiving slots, one of said pair of tongue receiving slots formed in each wall of said first pair of side walls, each said tongue receiving slot having a bottom supporting edge spaced from and substantially parallel to said bottom wall, a support surface formed on each of said walls of said second pair of walls, said support surfaces being substantially parallel to said bottom wall, said supporting edges and said support surfaces all being spaced from said bottom wall substantially the same distance, a discrete cooperating top closure comprising a substantially planer top wall having a first pair of tongues planer with said top wall and projecting from one pair of opposite side edges of said top wall and a second pair of tongues substantially planer with and extending from a second pair of opposed side edges of said top wall in the direction substantially perpendicular to the direction of extension of said first pair of tongues from said top wall, said second pair of side edges being substantially perpendicular to said first pair of side edges, said top wall and said tongues being proportioned relative to said top opening of said tray so that said tongues of said first pair of tongues are received one in each of said tongue receiving slots in said first pair of opposed side walls and said tongues of said second pair of tongues are supported one by each of said supporting surfaces when said top closure is in position closing said tray.

Preferably said free edges of said first pair of opposed walls will be positioned farther above said bottom wall than said free edges of said second pair of opposed walls.

Preferably each of said support surfaces forms a bottom edge of its respective one of a further pair of elongated tongue receiving slots.

Preferably, each of said side edges of said first and second pairs of opposed sides of said top wall will be bowed outwardly from the centre of said top wall and said tongues will project from the center of said bowed side edges outwardly therefrom.

Preferably, said top closure will be formed of corrugated board having a corrugated medium with the axis of the corrugations of said medium extending at an acute angle to said axis of projection of one of said first pair or said second pair of opposed tongues.

Preferably, said acute angle will be between 10° and 30°.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
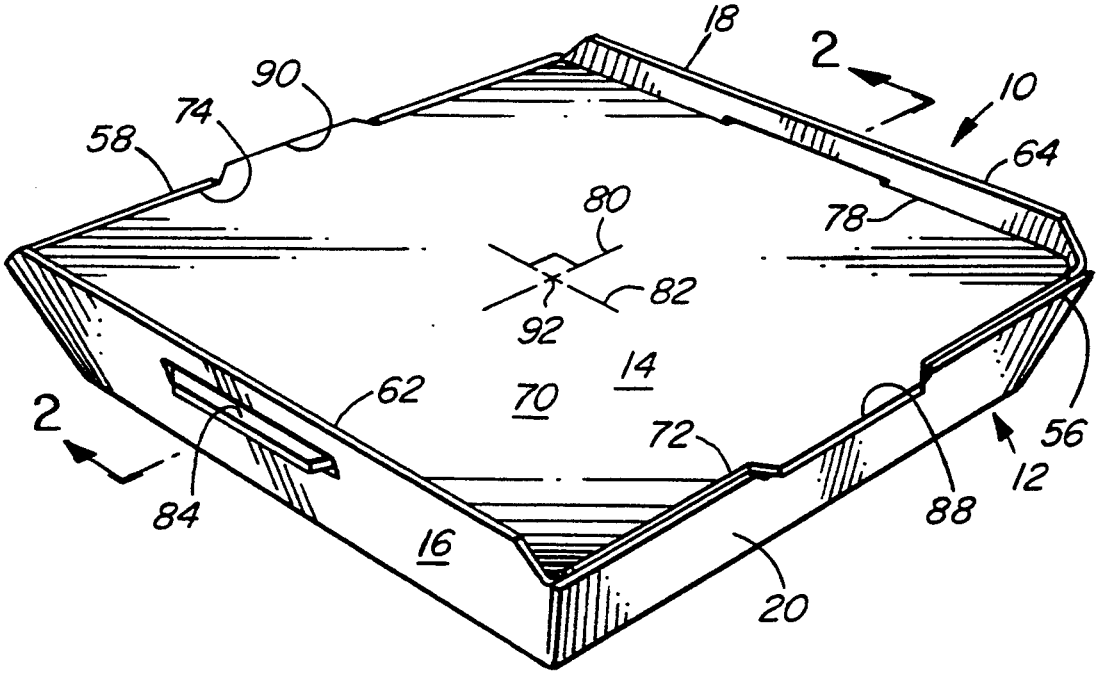
FIG. 1 is an isometric view of closed tray constructed in accordance with the present invention.

As shown in FIG. 1, the container 10 of the present invention is composed of a bottom tray 12 and a top closure member 14. The bottom tray 12 is formed by two pairs of opposed sides, a first pair of opposed side walls 16 and 18 longer than the second pair of opposed side walls 20 and 22 (see FIGS. 2 and 3) extending upward from a bottom wall 24.

Figure 3:
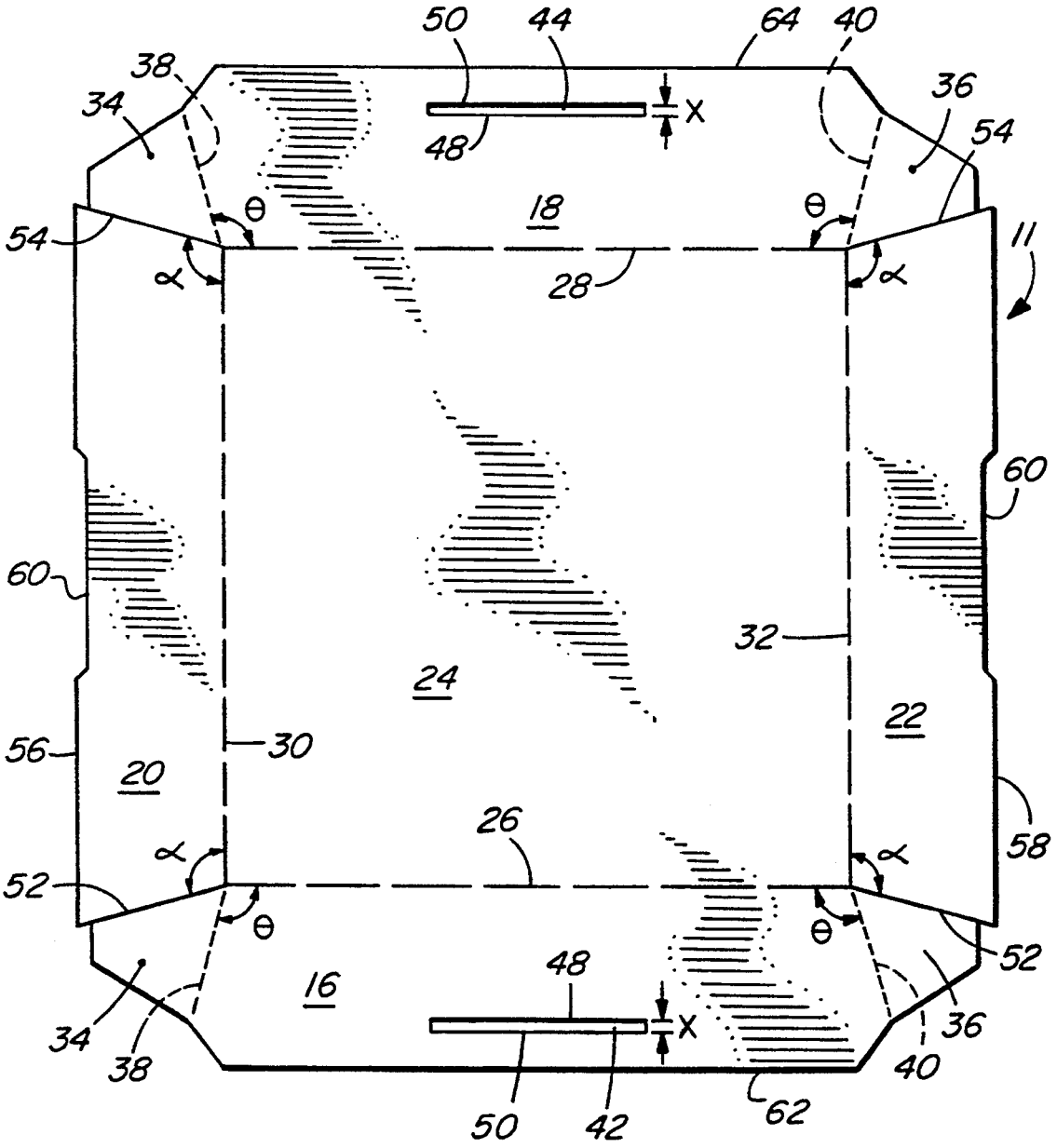
FIG. 3 is a plan view of a blank for forming the bottom tray.
Figure 4:
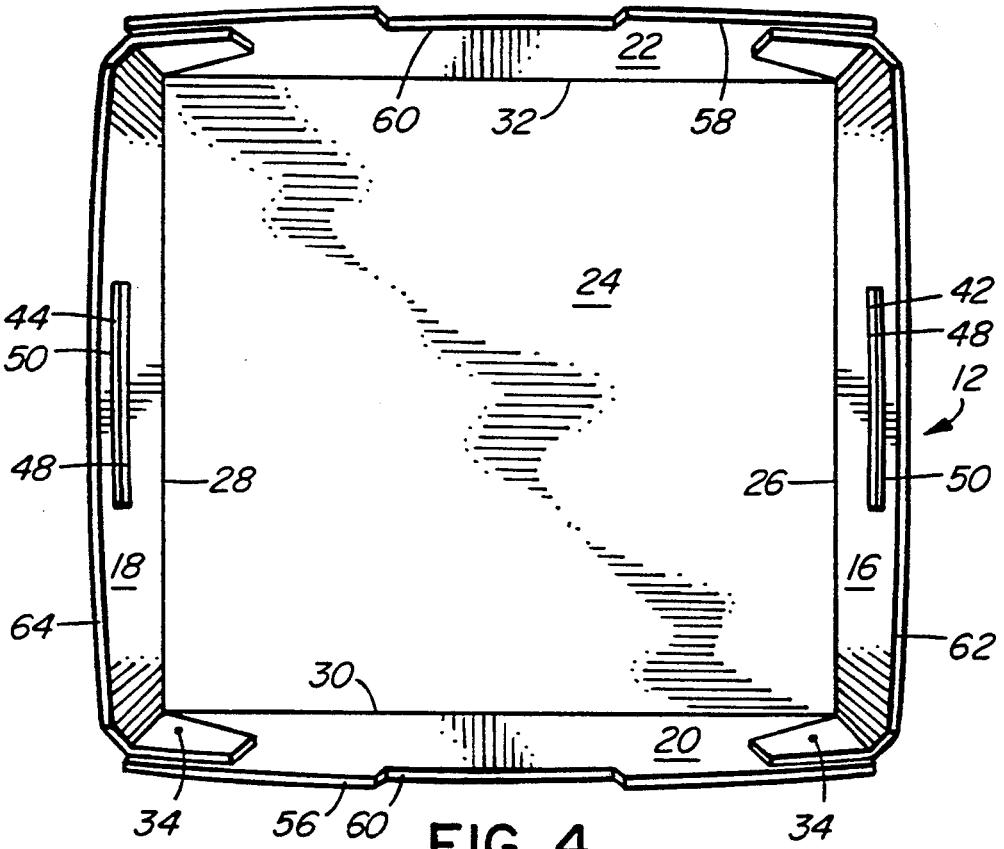
FIG. 4 is a plan view looking down into a tray formed for the blank of FIG. 3.

FIGS. 3 and 4 show respectively a plan view of the blank 11 from which the tray 12 is formed and the formed tray 12 formed therefrom. The blank 11 has a bottom wall 24 foldably connected to the first pair of end walls 16 and 18 via a pair of substantially parallel fold lines 26 and 28 to the other pair of opposed side walls 20 and 22 by a second pair parallel of fold lines 30 and 32 substantially perpendicular to the fold lines 26 and 28.

Connecting flaps 34 and 36 are connected one to each opposite end of the side walls 16 and 18 via a fold lines 38 and 40. These fold lines 38 and 40 extend at an angle Θ to their respective fold lines 26 and 28, Θ being an obtuse angle of approximately 105° to 130°.

Each of the side walls 16 and 18 is formed with its own tongue receiving slot 42 and 44 respectively. Each of these slots 42 and 44 are substantially uniform thickness slots having their bottom support edges 48 and their top edges 50 substantially parallel to the fold lines 26 and 28 so that when the tray 12 is erected. these opposed walls 48 and 50 are substantially parallel to the bottom wall 24. The widths of the slots 42 and 44 are essentially the same and are defined by the spacing X between the top and bottom edges of 50 and 48. X is slightly greater than the thickness of the top closure 14 which will be described herein below.

The pair of opposed walls 20 and 22, each have their end edges 52 and 54 extending at an angle $\alpha$ from their respective fold lines 30 and 32. The angle $\alpha$ will generally be approximately equal to the angle $\Theta$. The top or free edges 56 and 58 of the walls 22 and 24 have indentations that define support surfaces 60 that are substantially parallel to their adjacent fold lines 30 or 32 and thus, will be parallel to the bottom wall 24 when the tray is erected.

Figure 2:
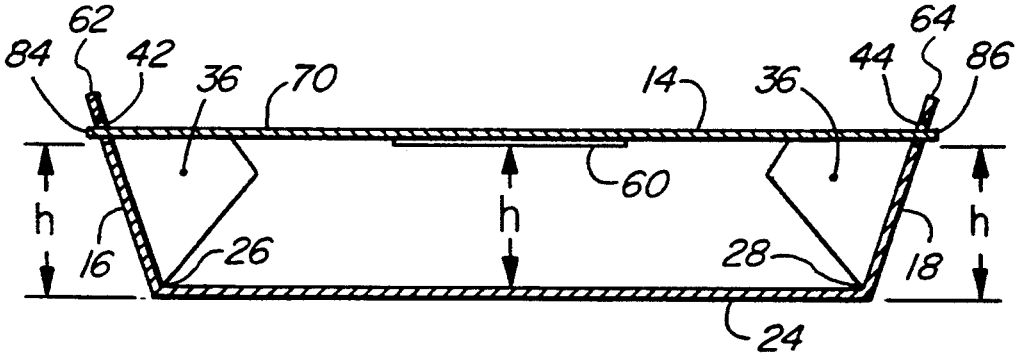
FIG. 2 is a section along the line 2—2 of FIG. 1.

As shown in FIG. 2, the height of the bottom support edges 48 and of the supporting surfaces 60 above the bottom wall 24 in the erected tray, i.e. height h are substantially equal so that tile surfaces 60 and the bottom edges 48 are in a common plane parallel to the bottom 24 whereby the top member 14 (supported by surfaces 60 and edge 48 as will be described) remains in a substantially planer position parallel to the bottom 24 when closing the top of the tray 12.

Figure 1A:
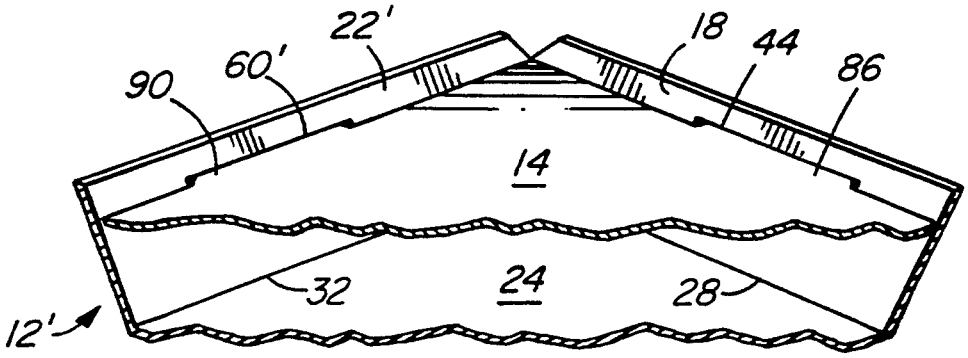
FIG. 1A is a partial view similar to FIG. 1 but showing a modified version of the invention.

Referring to FIG. 1A modified version of the present invention has been illustrated wherein the walls 20 and 22 have been extended to be essentially the same height above the bottom wall 24 as the walls 16 and 18, i.e. the walls 20 and 22 are replaced by extended walls only one of which is shown at $22^1$ wherein the support surfaces 60 form the bottom supporting edges of slots such as those indicated at $60^1$ in FIG. 1A, i.e. the support surfaces 60 in the embodiment of FIG. 1A are substantially equivalent to the bottom support edges 48 of the slots 42 and 44.

The bottom tray 12 is erected as shown in FIG. 4 by connecting the flaps 36 to the inside of wall 22 and the flaps 34 to the inside of wall 20 to form the tray 12 having an open top generally outlined on one pair of opposite sides by the free edges 56 and 58 of the wall 20 and 22 and the other pair of opposite sides by the free edges 62 and 64 of the walls 16 and 18. The top opening of the tray is defined in a plane spaced the height h from and parallel to the bottom wall 24 i.e. in the plane of the surfaces 60 and the bottom edges 48.

The top 14 is formed by a planar substantially rectangular panel 70 having a first pair of substantially parallel free edges 72 and 74 defining a first pair of opposite sides of the panel 70 (top 14) and a second pair of substantially parallel free edges 76 and 78 defining a second pair of sides of the panel 70 (top 14). The first pair of free edges 72 and 74 are substantially mutually perpendicular to the second pair of free edges 76 and 78 i.e. the edges 72 and 74 are substantially parallel to the first centre line 80 and the edges 76 and 78 substantially parallel to the centre line 82 substantially perpendicular to center line 80.

While the edges 72, 74, 76 and 78 have been defined as either substantially parallel or mutually perpendicular, these edge not be straight rather they may be slightly bowed so that, not withstanding the projecting tongues 84, 86, 88 and 90 be discussed below, the distance $d_1$ between the centre line 80 or 82 to the edge substantially parallel thereto measured adjacent to the points of intersection of the edge with mutually perpendicular edges is less than the parallel distance $d_2$ measured adjacent or along the other centre line. This bowing outward from the centre 92 (point of intersection of the centre lines 80 and 82) of the edges 72, 74, 76 and 78 results in more stable closing of the tray 12.

The peripheral dimensions of the panel 70 essentially correspond with the peripheral dimensions of the top opening of the tray 12 at its open end measured at the height h above the bottom 24, i.e. in the plane of the surfaces 48 and 60 except that the outward bowing of the edges 72, 74, 76 and 78 may make the top slightly larger than the top opening adjacent the centre of the walls of the tray 12 to ensure a snug fit of the lid 14 within the top opening of the tray 12, e.g. on a 10 inch wide tray by about $\frac{1}{8}$ inches.

A first pair of tongues 84 and 86 are symmetrical with the centre line 80 and project outward from the centre 92 in a direction parallel to the centre line 80 and a second pair of tongues 88 and 90 are mutually perpendicular with the tongues 84 and 86 and project outward from the centre 92 in a direction parallel to the centre line 82. In the illustrated arrangement the tongues 84 and 86 extend from their respective edges sufficient to be received within a project through the slots 42 and 44 respectively in the walls 16 and 18 and tongues 84 and 86 and slots 42 and 44 are dimensioned so the tongues are reasonably snugly received within their respective slot 42 or 44.

The tongues 88 and 90 in the illustrated arrangement are positioned and dimensioned relative to the support surfaces 60 to overlie and be supported by their respective underlying support surface 60 i.e. tongue 88 overlie the surface 60 on wall 16 and the tongue 90 overlies the surface 60 on the wall 18.

With the embodiment of FIG. 1A, the tongues 88 and 90 are received within their respective elongated slots $60^1$ formed in the extended walls 20 ($20^1$ not shown) and $22^1$ of the tray $12^1$ with the support surfaces 60 forming the bottom supporting edges of the elongated slots $60^1$ (only one shown) substantially equivalent to the bottom supporting edge 48 of the slots 42 (and 44).

It will be apparent that the FIG. 1A embodiment more securely locks the top 14 into the walls of the trays 12 since all of the tongues are now received within a their respective slots. It will also be apparent that deflection of the top or of the side walls is necessary to insert the tongues into their respective slots.

The illustrated tray 12 has a substantially square top opening so that the top may be arranged so that either the tongues 84 and 86 are received in slots 42 and 44 or alternatively, the top and bottom may be relatively rotated 90° and the tongues 88 and 90 received within the slots 42 and 44 in the tray illustrated in FIG. 1.

The tray and lid may be formed from any suitable material, but a corrugated board or single facet material is preferred. When a single facer is used, the corrugated medium may face into or out of the inside of the tray, however, for decorative purpose, it is preferred that the liner layer be on the outside to facilitate printing.

Figure 5:
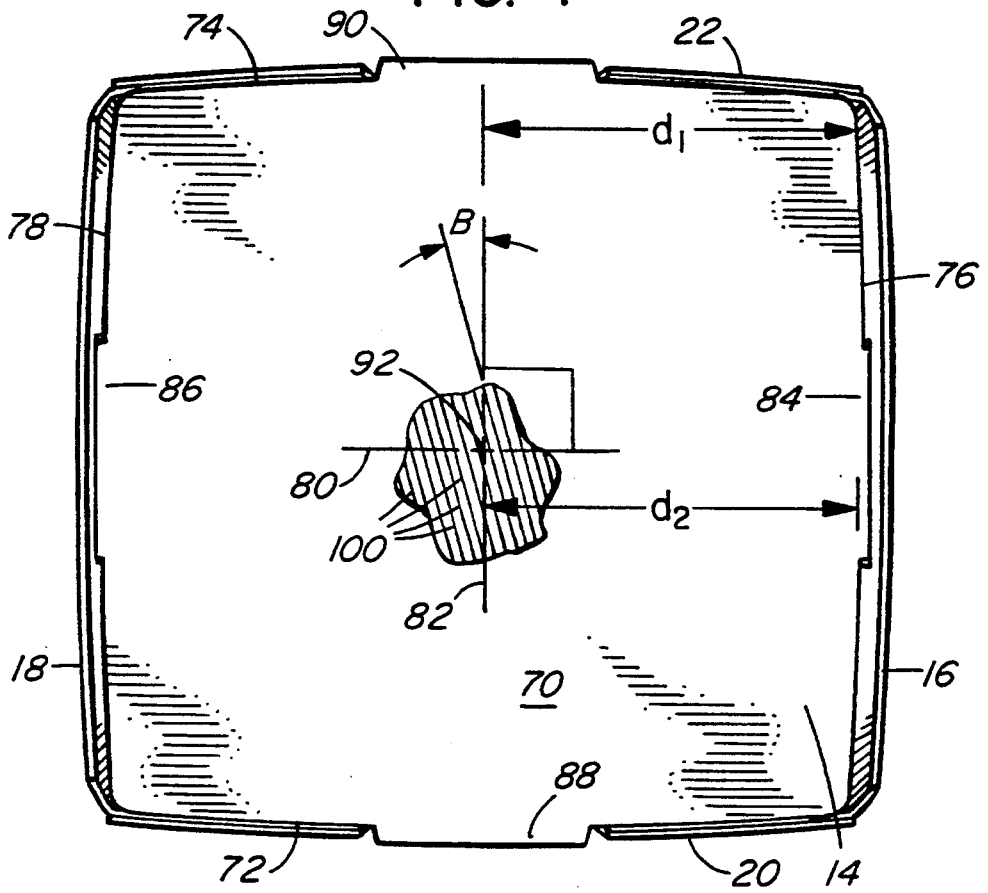
FIG. 5 is a plan view showing the tray closed and showing the configuration of the top closure.

It improves the lid structure when made of a corrugated board or single face material when the axes of the corrugations in the medium as indicated by the lines 100 in FIG. 5 extend at an angle intermediate to the two mutually perpendicular axes 80 and 82, i.e. at an angle $\beta$ to the axis 82. The angle $\beta$ will be between 5 and 45° preferably between 10° and 25°.

Having described the invention, modifications will be evident to those skilled in the art without departing from the scope of the invention as defined in the appended claims.

We claim:

1. A closable tray structure comprising a tray bottom having a bottom wall and a first pair of opposed side walls and a second pair of opposed side walls flaring upwardly from said bottom wall to provide a tray, free edges at the edges of said side walls remote from said bottom wall outlining the sides of a substantially rectangular top opening of said tray, a pair of elongated tongue receiving slots, one of said pair of tongue receiving slots formed in each wall of said first pair of side walls, each said tongue receiving slot having a bottom supporting edge spaced from and substantially parallel to said bottom wall, a support surface formed on each of said walls of said second pair of walls, said support surfaces being substantially parallel to said bottom wall, said bottom supporting edges and said support surfaces all being spaced from said bottom wall substantially the same distance, a discrete co-operating top closure comprising a substantially planer top wall having a first pair of tongues planer with said top wall and projecting outwardly one from the center of each edge of one pair of opposite side edges of said top wall and a second pair of tongues substantially planer with and extending outwardly one from the center of each edge of a second pair of opposed side edges of said top wall in the direction substantially perpendicular to the direction of extension of said first pair of tongues from said top wall, said second pair of side edges being substantially perpendicular to said first pair of side edges, said edges of said first and said second pairs of edges each being bowed outwardly at its center to form convex shaped edge, said top wall and said tongues being proportioned relative to said top opening of said tray so that said tongues of said first pair of tongues are received one in each of said tongue receiving slots in said first pair of opposed side walls and said first pair of edges apply greater pressure to their respect adjacent one of said first pair of opposed side walls adjacent to the center of their respective adjacent one of said first pair of side walls and said tongues of said second pair of tongues are supported one by each of said supporting surfaces when said top closure is in position closing said tray.

2. The closeable tray structure as defined in claim 1 wherein said free edges of said first pair of opposed walls are positioned farther above said bottom wall than said free edges of said second pair of opposed walls.

3. The closeable tray structure as defined in claim 1 wherein each of said support surfaces forms a bottom edge of its respective one of a further pair or elongated tongue receiving slots formed one in each of said second pair of side walls.

4. The closable tray structure as defined in claim 1 wherein said top closure is formed of corrugated board having a corrugated medium with the axis of the corrugations of said medium extending at an acute angle to said axis of projection of one of said first pair or said second pair of opposed tongues.

5. The closable tray structure as defined in claim 4 wherein said acute angle will be between 10° and 30°.

6. The closable tray structure as defined in claim 2 wherein said top closure is formed of corrugated board having a corrugated medium with the axis of the corrugations of said medium extending at an acute angle to said axis of projection of one of said first pair or said second pair of opposed tongues.

7. The closable tray structure as defined in claim 5 wherein said acute angle will be between 10° and 30°.

8. The closable tray structure as defined in claim 3 wherein said top closure is formed of corrugated board having a corrugated medium with the axis of the corrugations of said medium extending at an acute angle to said axis of projection of one of said first pair or said second pair of opposed tongues.

9. The closable tray structure as defined in claim 8 wherein said acute angle will be between 10° and 30°.

10. A tray structure as defined in claim 1 wherein said first and second pairs of opposed edges of said top walls are substantially all of equal length and said top wall is substantially square.

11. A tray structure as defined in claim 2 wherein said first and second pairs of opposed edges of said top walls are substantially all of equal length and said top wall is substantially square.

12. A tray structure as defined in claim 3 wherein said first and second pairs of opposed edges of said top walls are substantially all of equal length and said top wall is substantially square.

13. A tray structure as defined in claim 4 wherein said first and second pairs of opposed edges of said top walls are substantially all of equal length and said top wall is substantially square.

14. A tray structure as defined in claim 5 wherein said first and second pairs of opposed edges of said top walls are substantially all of equal length and said top wall is substantially square.

15. A tray structure as defined in claim 6 wherein said first and second pairs of opposed edges of said top walls are substantially all of equal length and said top wall is substantially square.

16. A tray structure as defined in claim 7 wherein said first and second pairs of opposed edges of said top walls are substantially all of equal length and said top wall is substantially square.

17. A tray structure as defined in claim 8 wherein said first and second pairs of opposed edges of said top walls are substantially all of equal length and said top wall is substantially square.

18. A tray structure as defined in claim 9 wherein said first and second pairs of opposed edges of said top walls are substantially all of equal length and said top wall is substantially square.

* * * * *

UNITED STATES PATENT AND TRADEMARK OFFICE

CERTIFICATE OF CORRECTION

PATENT NO. : 5,379,934

DATED : January 10, 1995

INVENTOR(S) : A.R. Lorenz

It is certified that error appears in the above-indentified patent and that said Letters Patent is hereby corrected as shown below:

On the title page: Item [73]

Assignee's Address should read: Vancouver, British Columbia

Signed and Sealed this

Twenty-ninth Day of August, 1995

*Attest:*

Bruce Lehman

BRUCE LEHMAN

*Attesting Officer*

*Commissioner of Patents and Trademarks*